US008230528B2

(12) United States Patent
Chiang

(10) Patent No.: US 8,230,528 B2
(45) Date of Patent: Jul. 31, 2012

(54) SWIMMING GOGGLES

(75) Inventor: Herman Chiang, Taipei Hsien (TW)

(73) Assignee: Global Esprit Inc., Taipei Hsien (TW)

( * ) Notice: Subject to any disclaimer, the term of this patent is extended or adjusted under 35 U.S.C. 154(b) by 330 days.

(21) Appl. No.: 12/720,131

(22) Filed: Mar. 9, 2010

(65) Prior Publication Data

US 2011/0219523 A1 Sep. 15, 2011

(51) Int. Cl.
*A61F 9/02* (2006.01)

(52) U.S. Cl. ..... 2/448; 24/DIG. 48; 24/593.11

(58) Field of Classification Search ..... 2/426, 431, 2/434, 452, 448, 450, 442, 15, 12; 351/43; 24/DIG. 48, 593.11, 68 SK, 68 J, 170
See application file for complete search history.

(56) References Cited

U.S. PATENT DOCUMENTS 7,020,905 B2 * 4/2006 Chiang ..... 2/448
2009/0205114 A1 * 8/2009 Chiang ..... 2/428
2011/0191948 A1 * 8/2011 Chiang ..... 2/440

* cited by examiner

*Primary Examiner* — Khoa Huynh
*Assistant Examiner* — Anna Kinsaul
(74) *Attorney, Agent, or Firm* — Rosenberg, Klein & Lee

(57) ABSTRACT

Swimming goggles include a frame body, lenses received in the frame body, and buckles assembled on a left side and a right side of the frame body. Each buckle includes a first cover and a second cover assembled together for accommodating and positioning a head strap, and a manipulation element mounted between the first cover and the second cover. The manipulation element has a bias bar and a manual bar interacting with each other to form an L shape for pivoting the first cover with the second cover according to the lever principle, a link arm extending axially from the manual bar, and a first flexible arm and a second flexible arm extending obliquely from opposite ends of the link arm in opposite direction. The first flexible arm and a second flexible arm respectively form a first pressing portion and a second pressing portion.

17 Claims, 7 Drawing Sheets

SWIMMING GOGGLES

BACKGROUND OF THE INVENTION

1. Field of the Invention

The present invention relates to swimming goggles, and particularly to swimming goggles which have an easily-adjustable head strap and are worn comfortably.

2. Related Art

Swimming goggles, generally, have buckles for accommodating and adjusting a head strap thereof. In prior art, buckles are respectively disposed on a left side and a right side of frames, and are assembled on two ends of a head strap for adjusting length. Each of the buckles comprises a biasing arm for abutting against the head strap. The biasing arm abuts against a serrated groove of the head strap in such a way that the head strap can be tightened merely in a single direction when the biasing arm does not abut the head strap (namely the head strap can be shortened only). The biasing arm has to be released for purpose of loosening the head strap. Thus, it is directly associated with adjustment of the head strap whether the biasing arm abuts against the head strap.

The prior art buckle, which controls abutment of the biasing arm, is commonly designed in compliance with a first lever principle to exert force on an end of a biasing arm, while the opposite end of the biasing arm acts in a reverse direction for releasing the biasing arm. At the same time, a resilient element acts on the end exerted force thereon for returning the biasing arm. In this way, whatever kind of assembly the resilient element has, two components are necessary to contact indirectly for manipulation. This makes manufacture and assembly more difficult, and increases cost. It is a desired issue how to improve the prior art buckles of the swimming goggles to meet the requirements of convenient use and simplified manufacture.

SUMMARY OF THE INVENTION

Accordingly, an object of the present invention is to provide swimming goggles which have simplified structure and assembly, and which have buckles separately formed for controlling abutment to the head strap and returning to original positions, thereby adjusting length of the head strap conveniently and facilitating manufacture and assembly.

The swimming goggles comprise a frame body, lenses received in the frame body, and buckles assembled on a left side and a right side of the frame body. Each buckle includes a first cover and a second cover assembled together for accommodating and positioning a head strap, and a manipulation element mounted between the first cover and the second cover. The manipulation element comprises a bias bar and a manual bar interacting with each other to form an L shape for pivoting the first cover with the second cover according to the lever principle, a link arm extending axially from a side of the manual bar, and a first flexible arm and a second flexible arm extending obliquely from opposite ends of the link arm in opposite directions. The first flexible arm and a second flexible arm respectively form a first pressing portion and a second pressing portion. When the first pressing portion and the second pressing portion are pressed downwardly, the first flexible arm and the second flexible arm are urged to be deformed upon pressure and to push the link arm. The link arm pushes the manual bar, and the manual bar displaces in a direction reverse to the manual bar, whereby the bias bar disengages from grooves of the head strap. When the first pressing portion and the second pressing portion are released, the first flexible arm and the second flexible arm produce return force due to deformation to return the bias bar to an original position.

Each buckle is separately formed, and has the functions of abutting against the head strap and returning to original positions automatically. In this way, the head strap is adjusted conveniently, and requirement for manufacture and assembly is lowered.

DESCRIPTION OF THE PREFERRED EMBODIMENTS

Figure 1:
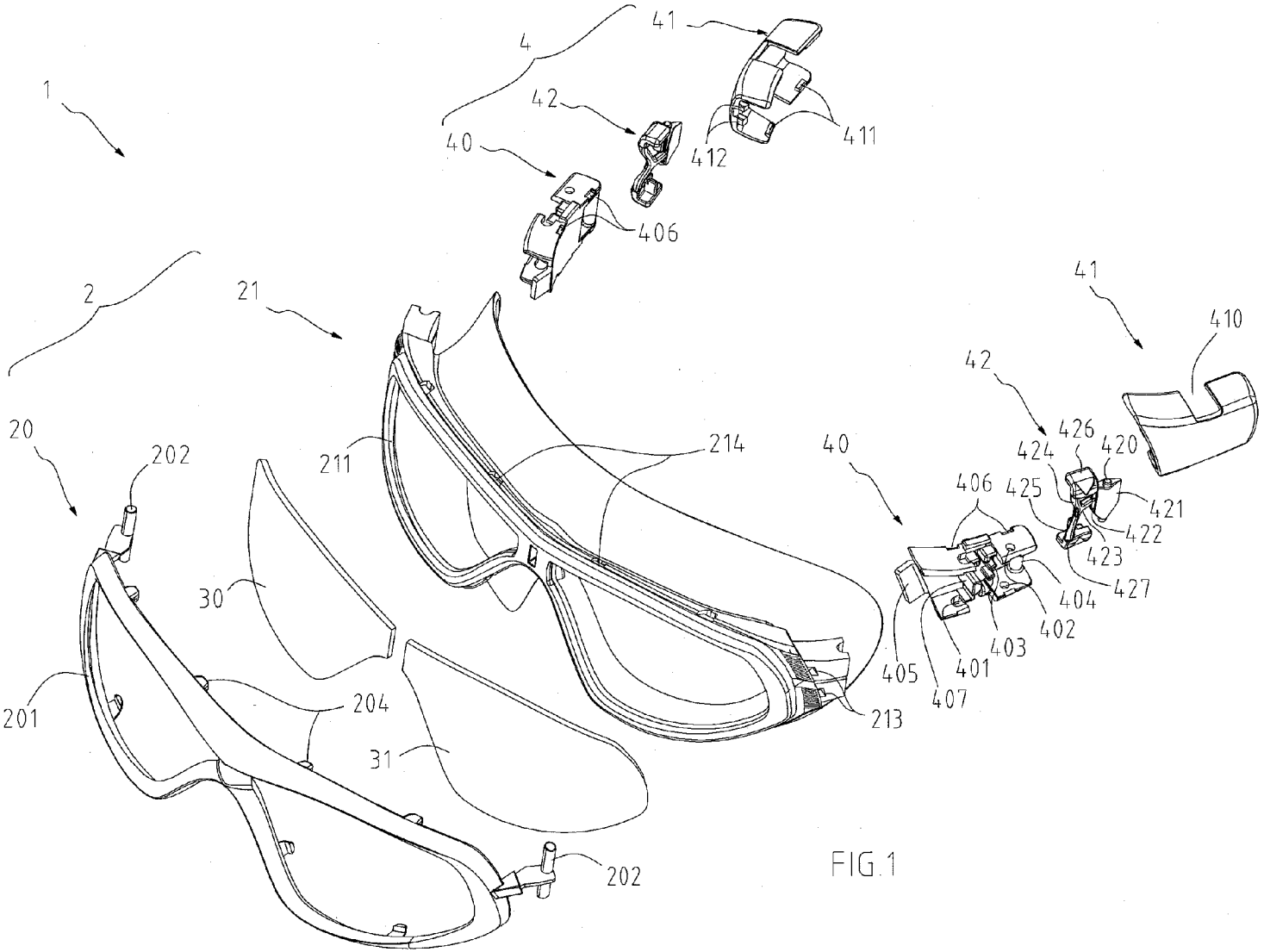
FIG. 1 is an exploded view of swimming goggles of the present invention.
Figure 2:
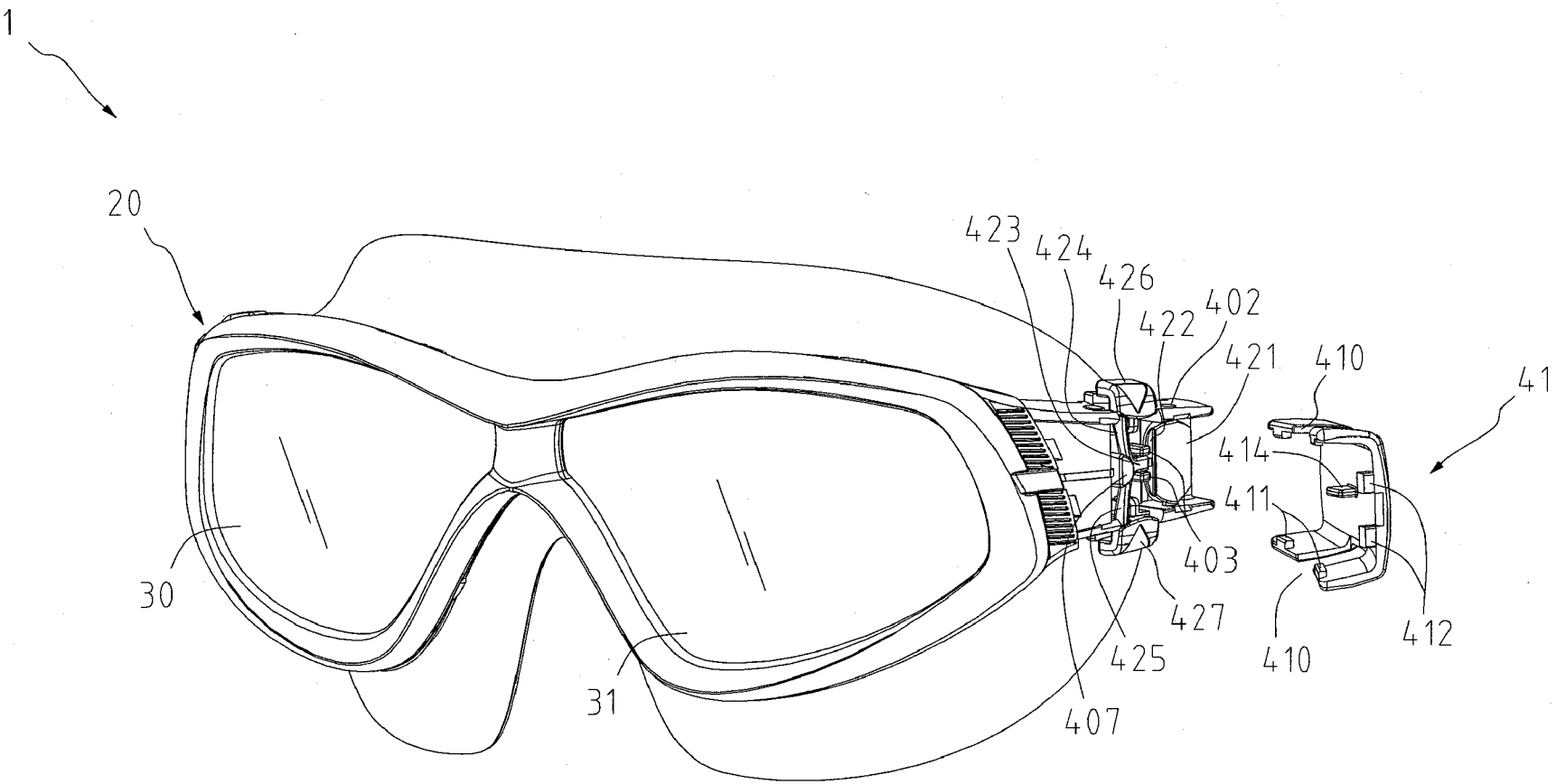
FIG. 2 is an assembled view of the swimming goggles, wherein a buckle thereof is disassembled for being clearly shown.
Figure 3:
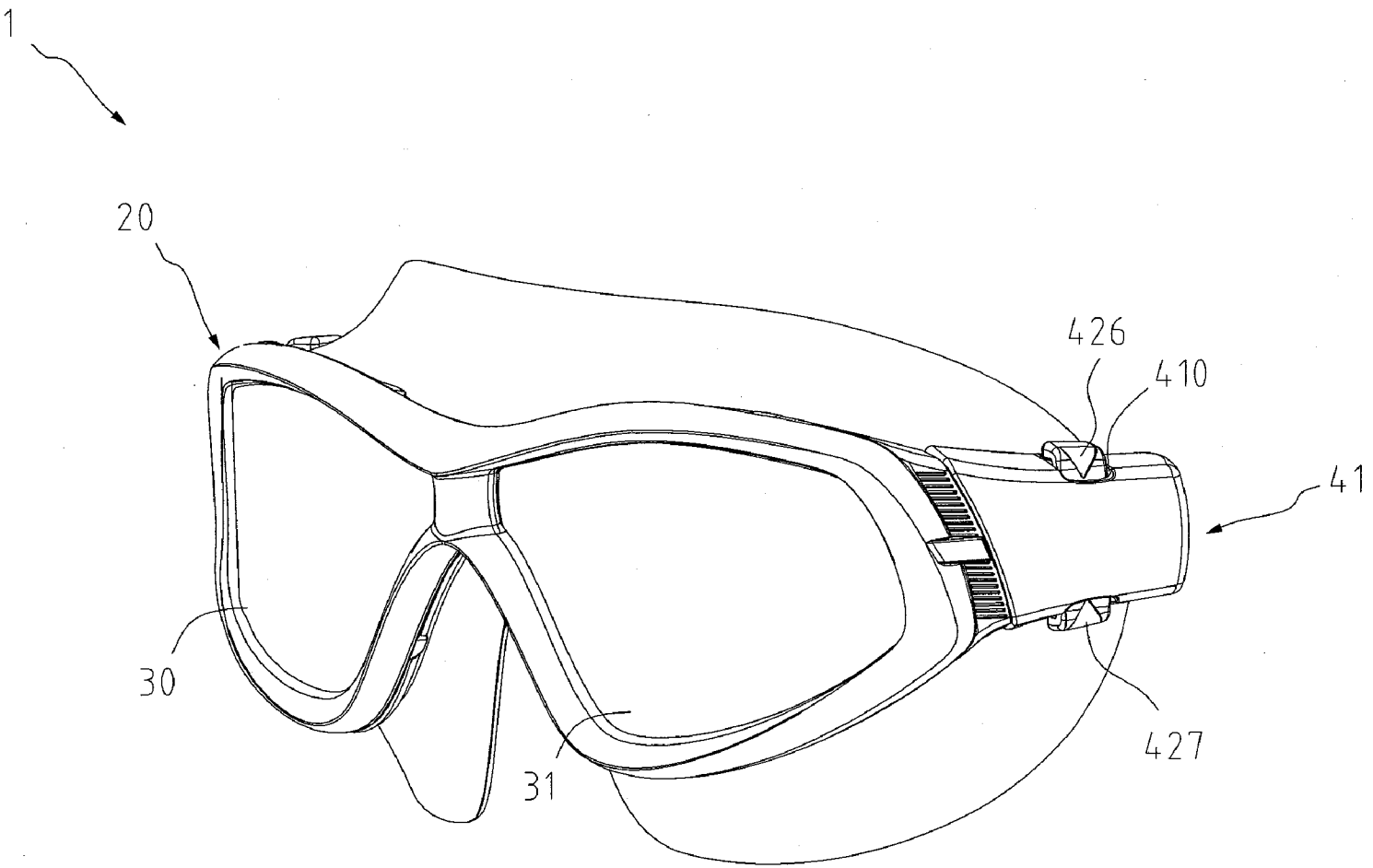
FIG. 3 is an assembled view of the swimming goggles.
Figure 4B:
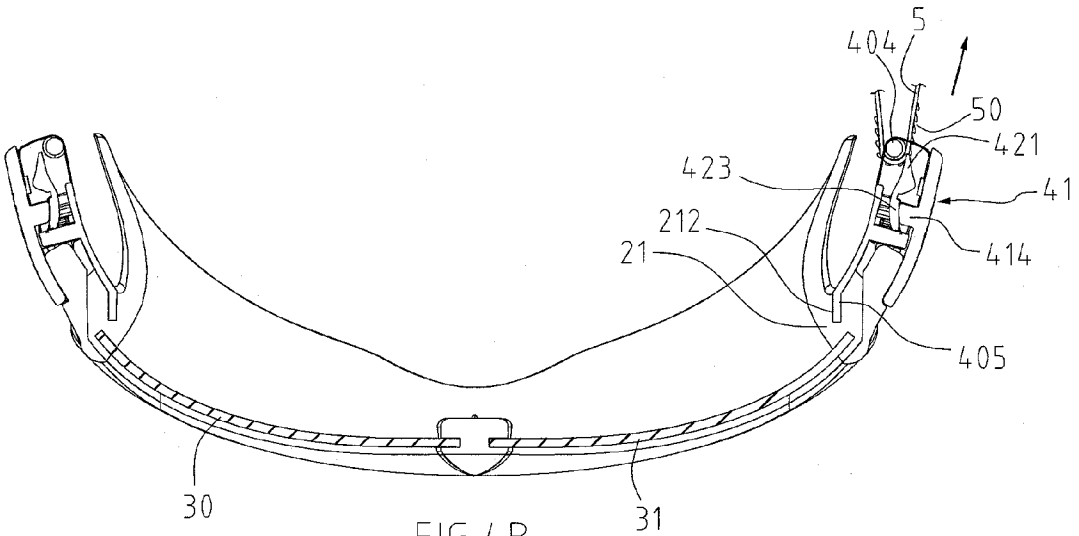
FIG. 4B is a cross-sectional view taken along the line 4B-4B in FIG. 4A.
Figure 4A:
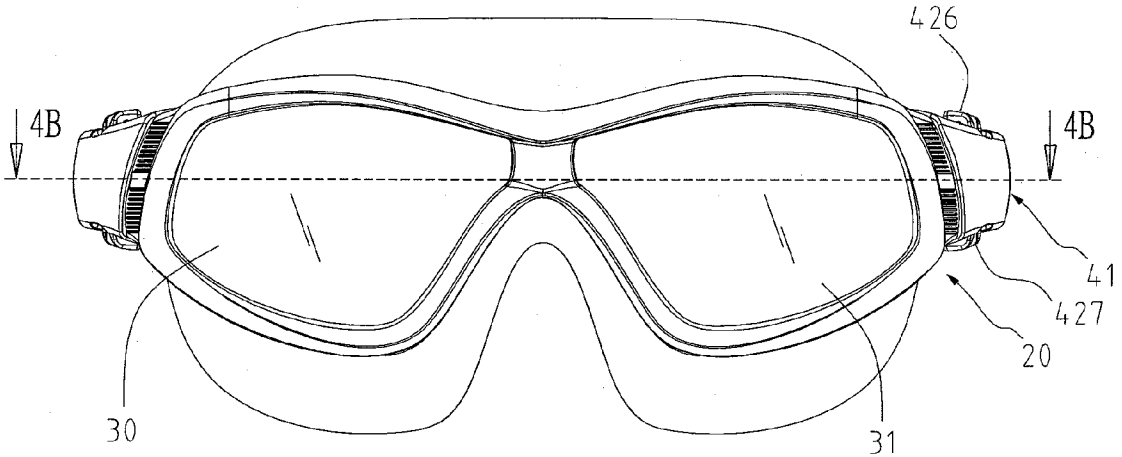
FIG. 4A is a front view of the swimming goggles of FIG. 3.
Figure 5A:
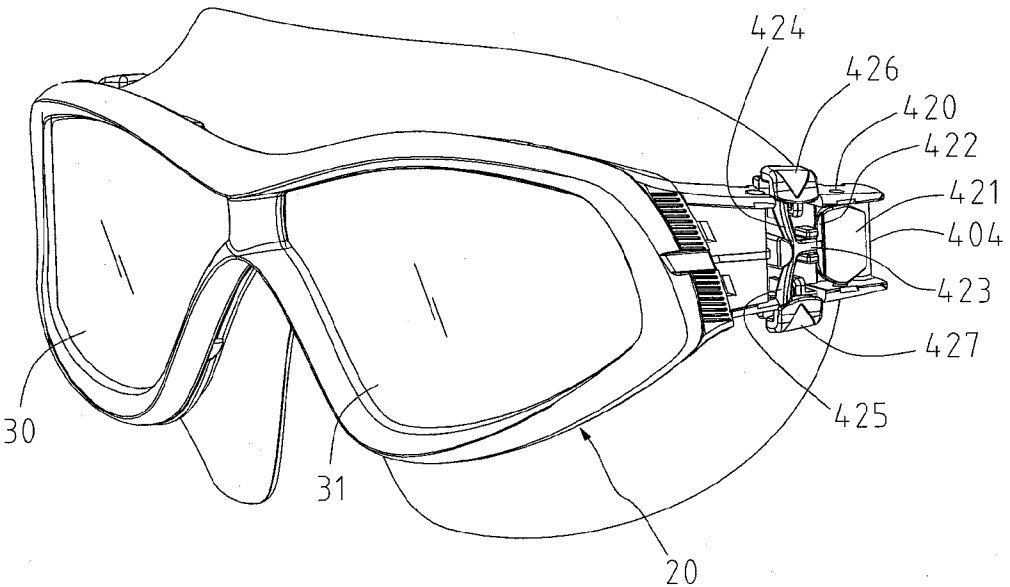
FIG. 5A is a perspective view of the swimming goggles with a second cover of a buckle being removed.
Figure 5B:
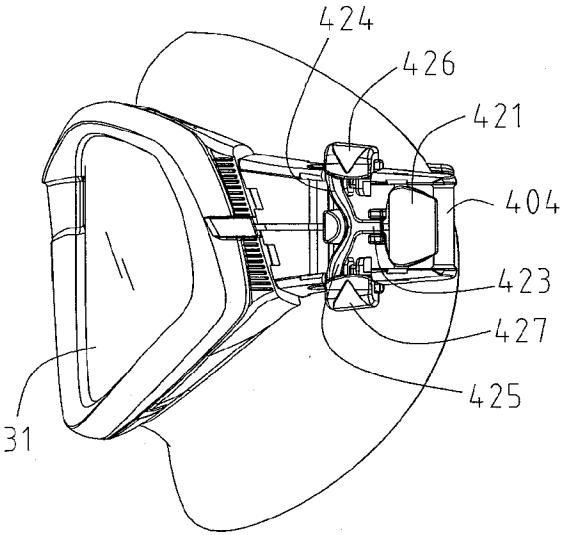
FIG. 5B is a side view of the swimming goggles of FIG. 5A.

With reference to FIGS. 1 through 3, swimming goggles 1 of the present invention comprise a frame body 2, lenses 30, 31, and buckles 4 assembled on a left side and a right side of the frame body 2. The frame body 2 includes a first assembling frame 20 and a second assembling frame 21, which are made of different materials and are integrally formed. The first assembling frame 20 is made of rigid material, for example PolyCarbonate resin. The second assembling frame 21 is made of soft material, for example Silicone Rubber. The first assembling frame 20 is enwrapped integrally by injection shaping technique for touching a user's face comfortably. The first assembling frame 20 forms latch arms 204, and the second assembling frame 21 defines latch grooves 214 for corresponding to the latch arms 204, thereby reinforcing assembly of the first assembling frame 20 and the second assembling frame 21. The first assembling frame 20 and the second assembling frame 21 respectively define first passageways 201 and second passageways 211 for receiving lenses 30, 31 therein. Assembling shafts 202 are respectively provided on a left side and a right side of the first assembling frame 20 for assembling with the buckles 4. Assembling openings 212 (see FIG. 4B) are respectively defined in a left side and a right side of the second assembling frame 21 for facilitating assembly of the buckles 4. The second assembling frame 21 further forms a touch portion (not labeled) for touching a user's face comfortably.

During shaping, the lenses 30, 31 are respectively assembled in the first passageways 201. When the second assembling frame 21 is formed by injection shaping, the first assembling frame 20 with the lenses 30, 31 are encompassed and received in the second passageways 211 of the second assembling frame 21.

Each buckle 4 comprises a first cover 40 and a second cover 41 assembled together for accommodating and positioning a head strap 5 (see FIG. 4B), and a manipulation element 42 assembled between the first cover 40 and the second cover 41. A shaft base 401 is formed on the first cover 40 for assembling with the assembling shaft 202 of the first assembling frame 20. The first cover 40 defines axial holes 402 for assembling with the manipulation element 42. A couple of stop walls 403 are formed inside the first cover 40 for limiting the manipulation element 42 appropriately. The first cover 40 forms an axial post 404 on one end thereof for positioning the head strap 5, and an assembling arm 405 on an opposite end for engaging with the assembling opening 212 of the second assembling frame 21. In this way, the first cover 40 and a lower portion of the second assembling frame 21 are assembled firmly (see FIG. 4B). Cutouts 410 are respectively defined in the second cover 41 and correspond to the manipulation element 42 for facilitating manual operation. The first cover 40 further forms a fixing post 407.

Locking tongues 411 are formed on an inward side of the second cover 41, and locking grooves 406 are defined in the first cover 40 for corresponding to the locking tongues 411. A plurality of latch tabs 412 are formed adjacent to a front end of the second cover 41, and embedding grooves 213 are defined in the second assembling frame 21 for corresponding to the latch tabs 412, thereby fixing an upper portion of the second assembling frame 21 and the second cover 41. Based upon the description above, the first cover 40 is retained on a lower portion of the second assembling frame 21, and the second cover 41 is retained on an upper portion of the second assembling frame 21.

The manipulation element 42 comprises a bias bar 421, a manual bar 422, a link arm 423, a first flexible arm 424 and a second flexible arm 425. The bias bar 421 and the manual bar 422 interact with each other to form an L shape, and the bias bar 421 abut against indented grooves of the head strap (see FIG. 4B). Projections 420 are formed on an interaction joint, which is formed between the bias bar 421 and the manual bar 422, for pivoting with the axial holes 402 of the first cover 40 so that the first cover 40 pivots to the second cover 41 according to the lever principle. The link arm 423 extends axially from a side of the manual bar 422 for being sandwiched between the stop walls 403 of the first cover 40, thereby limiting the link arm 423 appropriately in transverse direction. Preferably, the link arm 423 is in the vicinity of the manual bar 422. A rib 414, as shown in FIG. 2, is formed on the second cover 41 and corresponds to the link arm 423, for pressing appreciably on a top of the link arm 423 thereby limiting the link arm 423 appropriately when the second cover 41 is assembled on the first cover 40 (see FIG. 4B). The link arm 423, the first flexible arm 424 and the second flexible arm 425 are formed of flexible nylon. The first flexible arm 424 and the second flexible arm 425 extend obliquely from opposite ends of the link arm 423 in opposite directions. The first flexible arm 424 and the second flexible arm 425 respectively have thickness decreasing toward the link arm 423 for enhancing flexibility thereof. The first flexible arm 424 forms a first pressing portion 426, and the second flexible arm 425 forms a second pressing portion 427 for manual operation. In use, the first flexible arm 424 and the second flexible arm 425 respectively abut against the fixing post 407 of the first cover 40 for moving stably upon pressure.

In assembly, referring to FIGS. 1 to 3, the lenses 30, 31 are received in the first passageways 201 of the first assembling frame 20. The first assembling frame 20 and the lenses 30, 31 are enwrapped by the second passageways 211 of the second assembling frame 21 by means of injection shaping technique. The latch arms 204 of the first assembling frame 20 lock with the latch grooves 214 of the second assembling frame 21. The frame body 2 is completed. The shaft bases 401 of the first cover 40 are assembled with the assembling shafts 202 of the first assembling frame 20. The assembling arms 405 of the first cover 40 engage with the assembling openings 212 of the second assembling frame 21. In this way, the first cover 40 is fixed onto the lower portion of the second assembling frame 21 firmly. The latch tabs 412 of the second cover 41 lock with the embedding grooves 213 of the second assembling frame 21 for fixing the second cover 41 onto the upper portion of the second assembling frame 21. The second cover 41 and the first cover 40 are assembled with each other with retention, and are together assembled with the second assembling frame 21. Thus the swimming goggles are completed in assembly.

Figure 6B:
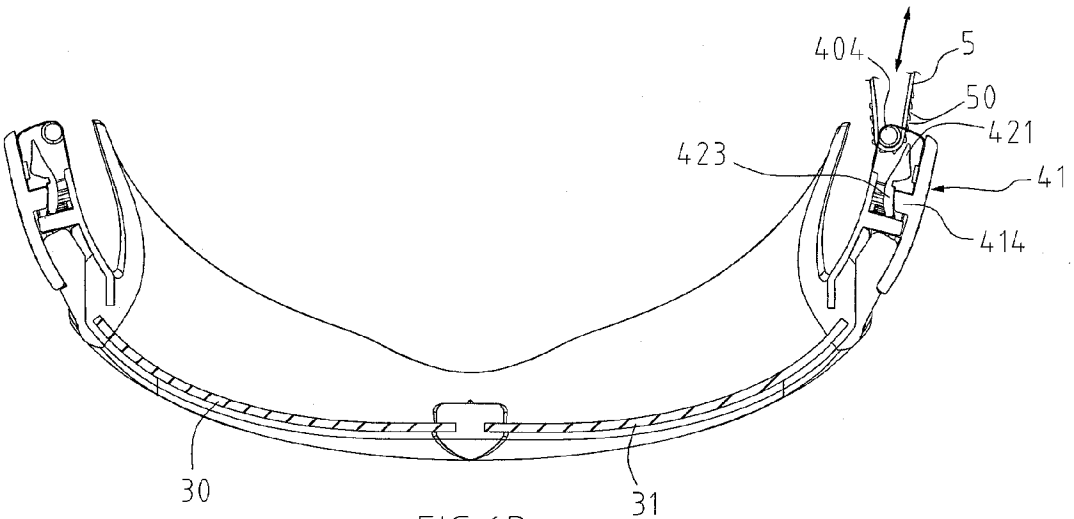
FIG. 6B is a cross-sectional view taken along the line 4B-4B in FIG. 6A.
Figure 6A:
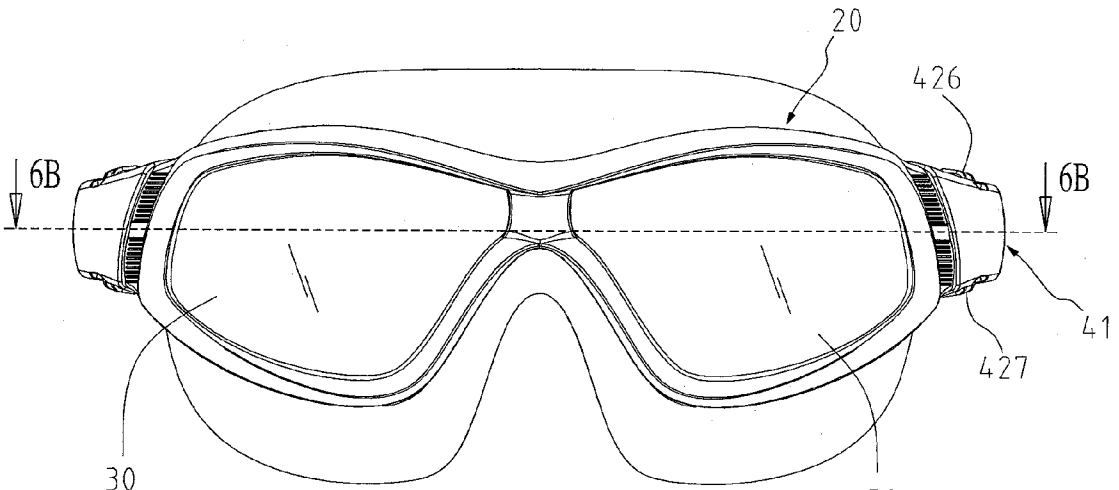
FIG. 6A is similar to FIG. 4A, wherein a first pressing portion and a second pressing portion of a buckle are pressed downward.
Figure 7A:
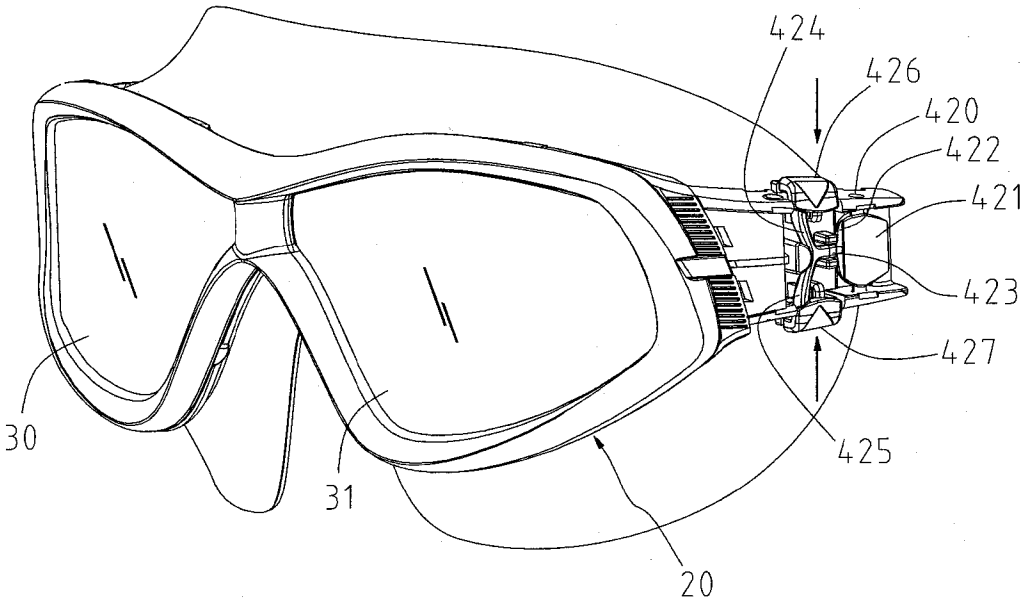
FIG. 7A is similar to FIG. 5A, wherein the first pressing portion and the second pressing portion are pressed downward.
Figure 7B:
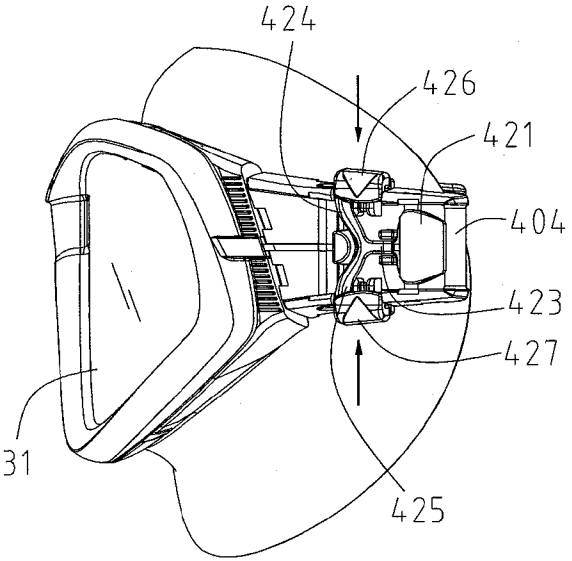
FIG. 7B is a side view of the swimming goggles of FIG. 7A.

With reference to FIGS. 4A, 4B, 7A and 7B, when assembled, the head strap 5 extends around the axial posts 404 of the first covers 40. The bias bar 421 abut against indented grooves 50 of the head strap 5 so that the head strap 5 is permitted to tighten in a single direction merely. That is, the head strap 5 is merely allowed to be pulled outwardly (as the arrow in FIG. 4A) for being shortened. In order to adjust the length of the head strap 5, a user's thumb and other fingers press the first pressing portion 426 and the second pressing portion 427 downwardly (see FIGS. 7A and 7B). The first flexible arm 424 and the second flexible arm 425 are urged to be deformed upon pressure, and push the link arm 423 laterally. The manual bar 422 are pushed by the link arm 423, and displaces in a direction reverse to the manual bar 422 with the projections 420 serving as fulcrum. The bias bars 421 are released to disengage from the indented grooves 50 of the head strap 5, allowing bi-directional adjustment of the head strap 5 (see FIGS. 6A and 6B). When the first pressing portion 426 and the second pressing portion 427 are released, the first flexible arm 424 and the second flexible arm 425 produce return force due to deformation for returning the bias bar 421 to an original position.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles, having a head strap defining grooves therein, comprising: a frame body; lenses received in the frame body; and buckles assembled on a left side and a right side of the frame body, each buckle comprising: a first cover and a second cover assembled together for accommodating and positioning the head strap; and a manipulation element mounted between the first cover and the second cover, and including: a bias bar and a manual bar interacting with each other to form an L shape for pivoting the first cover with the second cover according to the lever principle, and the bias bar abut against indented grooves of the head strap; a link arm, having two ends, one end of the link arm extending from the manual bar; and a first flexible arm and a second flexible arm extending obliquely from an opposite end of the link arm, the first and second flexible arms extending in opposite directions away from the link arm, and respectively forming a first pressing portion and a second pressing portion separate of the manual bar, wherein when the first pressing portion and the second pressing portion are pressed simultaneously, the first flexible arm and the second flexible arm are urged to be deformed upon pressure and to push the link arm, the link arm pushing the manual bar, the manual bar displacing in a direction reverse to the manual bar, whereby the bias bar disengages from the head strap.

2. The swimming goggles as claimed in claim 1, wherein projections are formed on an interaction joint between the bias bar and the manual bar, and wherein axial holes are defined in the first cover for assembling with the projections.

3. The swimming goggles as claimed in claim 1, wherein the link arm extends from a side of the manual bar.

4. The swimming goggles as claimed in claim 1, wherein the first flexible arm and the second flexible arm respectively have thickness decreasing toward the link arm for enhancing flexibility thereof.

5. The swimming goggles as claimed in claim 4, wherein the link arm, the first flexible arm and the second flexible arm are formed of flexible nylon.

6. The swimming goggles as claimed in claim 1, wherein the first cover forms stop walls thereon for sandwiching the link arms therebetween, thereby limiting the link arm appropriately in a transverse direction, and wherein a rib is formed on the second cover and corresponds to the link arm for pressing a top of the link arm thereby limiting the link arm appropriately when the second cover is assembled on the first cover.

7. The swimming goggles as claimed in claim 1, wherein the frame body includes a first assembling frame and a second assembling frame, which are made of different materials and are integrally formed, wherein the first assembling frame is made of rigid material, and the second assembling frame is made of soft material for enwrapping the first assembling frame integrally, and wherein the first assembling frame and the second assembling frame respectively define first passageways and second passageways for receiving lenses therein.

8. The swimming goggles as claimed in claim 7, wherein the first cover forms an axial post on one end thereof for positioning the head strap.

9. The swimming goggles as claimed in claim 8, wherein the first cover forms an assembling arm on another end opposite to the axial post, and wherein the second assembling frame defines an assembling opening therein for engaging with the assembling arm.

10. The swimming goggles as claimed in claim 7, wherein the first assembling frame forms latch arms, and the second assembling frame defines latch grooves for corresponding to the latch arms, thereby reinforcing assembly of the first assembling frame and the second assembling frame.

11. The swimming goggles as claimed in claim 10, wherein cutouts are respectively defined in the second cover, and correspond to the first pressing portion and the second pressing portion for facilitating manual operation.

12. The swimming goggles as claimed in claim 7, wherein locking tongues are formed on the second cover, and locking grooves are defined in the first cover for corresponding to the locking tongues.

13. The swimming goggles as claimed in claim 12, wherein a plurality of latch tabs are formed adjacent to a front end of the second cover, and a plurality of embedding grooves are defined in the second assembling frame for corresponding to the latch tabs, thereby fixing an upper portion of the second assembling frame with the second cover.

14. The swimming goggles as claimed in claim 13, wherein the first cover forms shaft bases thereon, and the first assembling frame forms assembling shafts for engaging with the shaft bases, whereby the first cover is fixed onto a lower portion of the second assembling frame.

15. The swimming goggles as claimed in claim 7, wherein the first cover forms a fixing post, the first flexible arm and the second flexible arm respectively abutting against the fixing post for moving stably upon pressure.

16. The swimming goggles as claimed in claim 7, wherein the first assembling frame is made of PolyCarbonate resin, and wherein the second assembling frame is made of Silicone Rubber.

17. The swimming goggles as claimed in claim 16, wherein the second assembling frame further forms a touch portion for touching a user's face comfortably.

* * * * *